United States Patent [19]

Choate

[11] Patent Number: 4,607,445

[45] Date of Patent: Aug. 26, 1986

[54] TEMPERATURE COMPENSATING FRONT SIGHT

[75] Inventor: Paul V. Choate, Milton, Mass.

[73] Assignee: N I Industries, Los Angeles, Calif.

[21] Appl. No.: 617,377

[22] Filed: Jun. 4, 1984

[51] Int. Cl.[4] ..... F41G 1/00

[52] U.S. Cl. ..... 42/100; 33/254; 33/255

[58] Field of Search ..... 42/1 S, 1 ST; 33/233, 33/254, 255, 261

[56] References Cited

U.S. PATENT DOCUMENTS

| | | | |
|---|---|---|---|
| 1,964,027 | 6/1934 | Bliss | 33/261 |
| 3,279,072 | 10/1966 | Choate et al. | 33/254 |
| 4,531,445 | 7/1985 | Nee | 89/1.813 |

*Primary Examiner*—Deborah L. Kyle
*Assistant Examiner*—Michael J. Carone

[57] ABSTRACT

Launchers of the type that are extensible when readied for use contain projectiles the efficiency of the propellants of which varies directly with their temperature. Prior to the extension of such launchers, they are water tight and their interiors are thermally insulated and when extended, the rear and front sights become erected.

The front sight, prior to launcher extension is within and thermally insulated by a housing sealed to the launcher and having a chamber in which one end of a bimetallic element is anchored. Above the chamber, the sight housing slidably supports for vertical movement a sighting member having a sighting post and a depending supporting post extending into the chamber and is there connected to the other end of the element. A slidable connection of a tongue and groove type between the upper end of the housing and the sighting member and its supporting post prevents any misalignment of the sighting post in any position thereof established and maintained by the element so that when the launcher is readied for use, the front sight compensates for the existing efficiency of the propellant.

6 Claims, 10 Drawing Figures

TEMPERATURE COMPENSATING FRONT SIGHT

BACKGROUND REFERENCE

U.S. Pat. No. 3,279,072.

BACKGROUND OF THE INVENTION

With weapons using a propellant that is substantially insensitive to temperature fluctuations, sighting systems need only to be adjustable to maintain the point of aim at varying distances from the target and, in many systems, to allow for the effects of cross winds.

Propellants such as certain propellants used in the projectiles of extensible launchers present an additional problem in that they are sensitive to temperature changes with their efficiency decreasing as the temperature falls below a predetermined normal and increasing as the temperature rises above that level. Distances and the effects of cross winds are relatively easily determined as compared to the effects of temperature changes of the propellant. The launchers, until extended, are water tight and insulate the propellant against responding, but slowly, to temperatures to which the launchers are exposed.

Reference is made to the patent to Choate et al, U.S. Pat. No. 3,279,072, in which the problem of propellant efficiency in relation to temperature changes was solved by providing a rear sight which would respond to temperature changes with its thermally responsive element thermally insulated within the sight so as to reflect the temperature of the propellant thus automatically to maintain the proper point of aim.

The use of such sights required that adjustments for distance be made by means of a front sight. The resulting sighting system has proved to effectively eliminate problems in the changes in propellant efficiency due to changes in its temperature. A disadvantage is that, conventionally, compensation for distance is by means of a vertically adjustable rear "peep" sight, that may also be adjustable for windage. In addition, a sight in accordance with the patent necessarily had both the apertured sighting member and the thermally responsive member fully enclosed with the aperture moving vertically between front and rear windows and, as a consequence, such sights are relatively expensive.

THE PRESENT INVENTION

The general objective of the present invention is to provide a front sight for use with launchers where the efficiency of the propellant for the projectile is temperature responsive and which will automatically and accurately compensate for losses or gains in propellant efficiency.

In accordance with the invention, this objective is attained with a front sight having a housing which, like the front sights of the Choate et al, U.S. Pat. No. 3,122,059, and the copending application of Michael A. Nee, Ser. No. 548,977, now U.S. Pat. No. 4,531,445 filed Nov. 7, 1983, is pivotaly mounted within the muzzle end of a housing sealed to a section of an extensible launcher to be erected by a spring when a port in that housing is opened which it is as an incident of launcher extension. The front sight is substantially and effectively insulated while within the housing of the launcher until thus erected as is the projectile.

The housing of the front sight has a chamber in which one end of a bimetallic, thermally responsive element is anchored. A sighting member has a sighting post and a depending supporting post slidably supported by the sight housing above the chamber with the supporting post extending into the chamber and there connected to the other end of the bimetallic element.

The upper end of the housing has a connection with the sighting member of the tongue and groove type that extends substantially the full length thereof and of the sighting member and its supporting post which connection prevents misalignment of the sighting post in any position thereof established by the element which maintains the sighting post against any independent vertical movement thereof.

The sighting member consists of sections which, when interconnected, provide the chamber, pivot receiving ears at the bottom end of the sight housing, an upwardly and laterally opening seat for the sighting member at the upper end of the housing and a short throat between the seat and the chamber with the tongue or rib extending lengthwise of the surface of one section between the chamber and the upper end of the seat and the groove is a slot extending substantially the full length of the sighting member and its supporting post.

Other objectives of the invention and the manner in which they are attained will be apparent from the following description of a preferred embodiment and the appended claims.

BRIEF DESCRIPTION OF THE DRAWINGS

The accompanying drawings illustrate a preferred embodiment of the invention of which

THE PREFERRED EMBODIMENT OF THE INVENTION

As previously stated, the preferred embodiment of the front sight is shown as incorporated in a projectile launcher which is in accordance with the copending application of Michael A. Nee, Ser. No. 548,977, filed Nov. 7, 1983, U.S. Pat. No. 4,531,445.

The launcher is generally indicated at 10 and while a full description thereof is not necessary for a general appreciation of front sights in accordance with the invention, certain of the front sight features are more readily appreciated when considered with certain features and the functioning of the launcher 10 thus making a general description thereof desirable.

Figures 1, 2, 3:
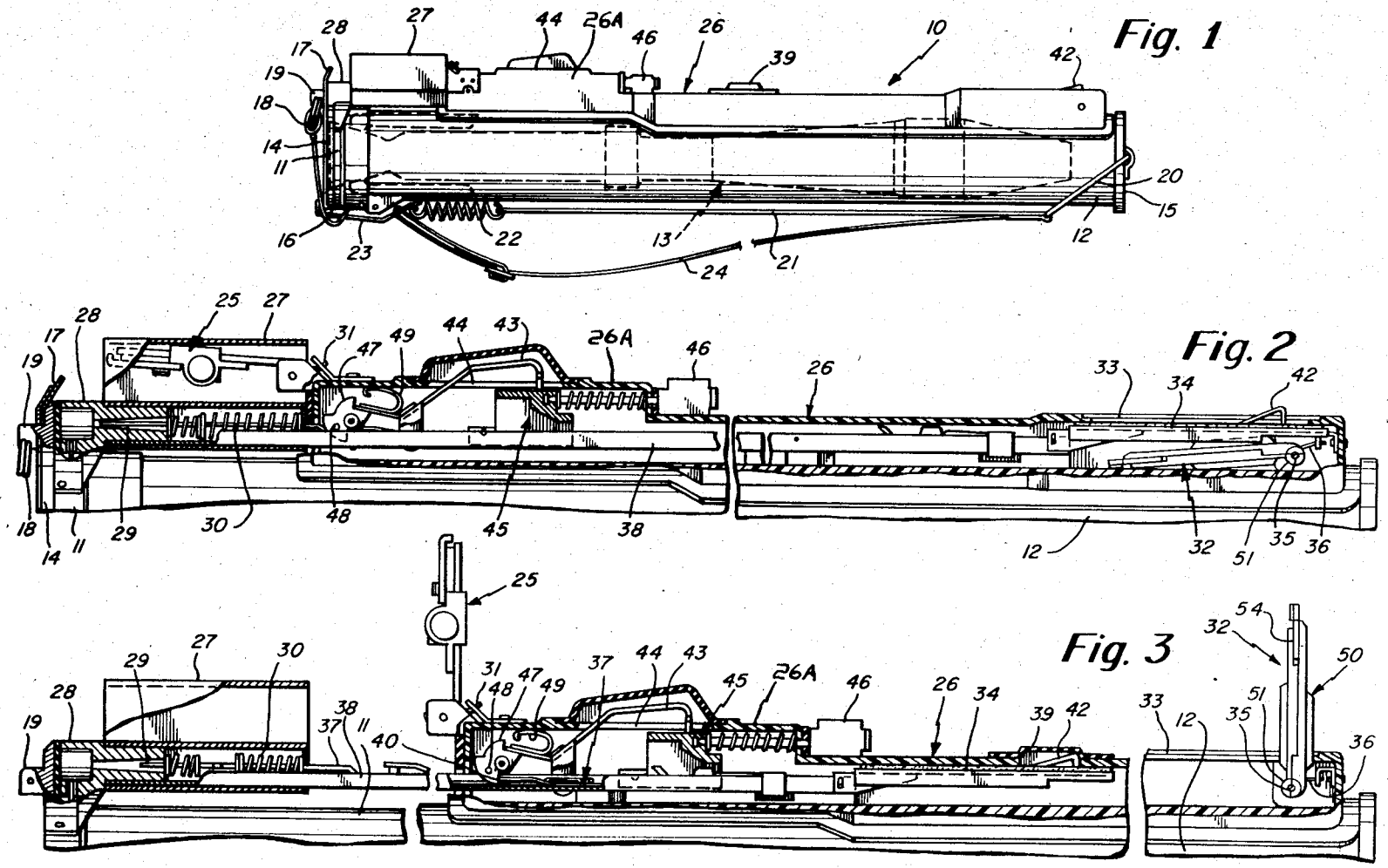
FIG. 1 is a side view of an extensible projectile launcher in its shortened inoperative state equipped with a front sight in accordance with the present invention.
FIG. 2 is a fragmentary and foreshortened view showing the front and rear sights when the launcher is in its shortened state.
FIG. 3 is a like view but with the launcher in its extended state with the sights erected.
Figure 4:
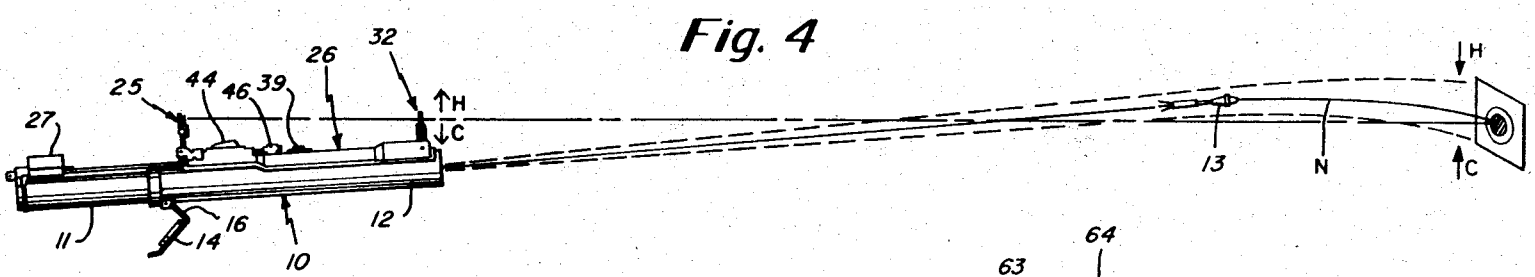
FIG. 4 is a view with the launcher in its extended state illustrating the functions of the front sight.

The launcher 10 has a first or breech section 11 which is telescopingly fitted within a second or muzzle section 12 thus to enable the launcher to be extended from its shortened, inoperative state illustrated by FIG. 1, in which it may be carried conveniently, into its extended state in which the contained projectile 13 is ready to be launched, see FIG. 4.

The breech end of the section 11 and the muzzle of the section 12 are closed by end caps 14 and 15, respectively, which together with seals and certain other later referred to features serve to render the launcher 10 water tight in its shortened state.

The rear cap 14 has, see FIGS. 1 and 4, an arm 16 extending at right angles from its lower margin and pivotally connected to the section 11 close to the rear end thereof. The rear cap 14 also has a diametrically disposed tab 17 fitting over and locked by a removable pin 18 to a rearwardly disposed lug 19 with which the launcher section 11 is provided. The front cap 15 has a yoke 20 connected to a strap 21 having a resilient section 22 which includes a hook 23 caught on the edge of the end cap 14 and overlying the arm 16. A carrying strap 24 is attached to the yoke 20 and to the shank of the hook 23.

With the removal of the pin 18, the rear cap 14 is swung open by means of its tab, the hook 23 becomes disengaged therefrom and it, the straps and the front cap 15 fall free. The launcher can then be extended. For more complete details of the above feature, reference is made to Choate et al U.S. Pat. No. 3,122,059.

The rear sight, generally indicated at 25 and forming no part of the present invention but shown as illustrative of a so-called "peep" sight, providing for range and windage adjustments, is pivotally connected to the rear end of a housing 26 which is sealed to and extending substantially the full length of the launcher section 12. In the shortened state of the launcher, the rear sight 25 is slidably confined in a chamber 27 mounted on a housing 28 containing the firing pin 29 and the firing spring 30 and fixed on the breech end of the launcher section 11. The rear sight 25 is held by the chamber 27 from being erected by the spring 31 until the launcher has been so extended that the rear sight is pulled free of the chamber 27.

In the shortened state of the launcher 10, the firing spring 30 is untensioned and the front sight, generally indicated at 32, is below an oblong port 33 in the front end of the housing 26 which is closed by an underlying plate 34. The front sight 32 is connected by a pivot 35 to the sidewalls of the housing 26 and is erected and seated against the front edge of the port 33 by a spring 36 when the plate 34 is positioned rearwardly of the port 33 as it is when the launcher is extended for use.

As the launcher sections are made of reinforced fiber glass and the housing 26 of fiber glass reinforced plastic, both the front sight 32 and the propellant of the projectile 13 are sufficiently well insulated, when the launcher is in its shortened state, so that they respnd but slowly to ambient temperatures with their respective temperatures sufficiently close to meet the requirements of the present invention.

As is more fully described in said co-pending application, the firing pin 29 is the rear part of a firing member, generally indicated at 37, extending forwardly into and lengthwise of the housing 26 and slidably supported by a channel 38. The channel 38 is anchored to the housing 28 and is slidably supported by the launcher section 12. The housing 26 has a chamber 26A between which and the oblong port 33 there is a boot covered port 39.

Figure 5:
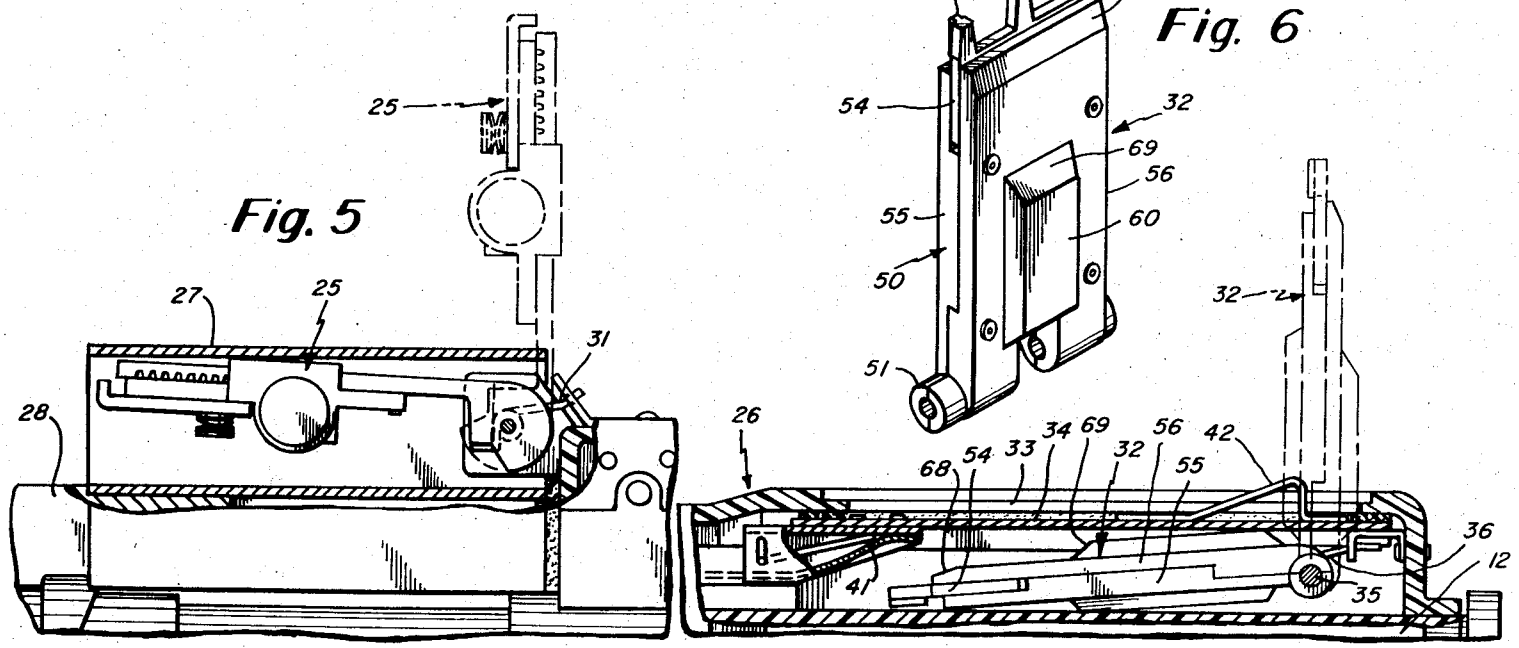
FIG. 5 is a view generally similar to FIG. 2 but on a substantial increase in scale.

The firing member 36 has transverse, laterally projecting shoulders 40, see FIG. 3, and the plate 34 is pivotally connected to the front end of the channel 38 in a manner enabling the plate 34 to move vertically relative thereto. A spring 41, see FIG. 5, attached to the firing member yieldably urges the plate 34 upwardly so that it is in sealing engagement with the margins of the port 33. The upper surface of the plate 34 has a latch 42 fixed thereon which enters the boot covered port 39 under the influence of the spring 41 when the launcher is fully extended thus to then releasably lock the sections 11 and 12 together.

A trigger 43 is pivotally mounted in the chamber 26A and is operable by digital pressure applied thereto through a boot covered port 44 when the safety, generally indicated at 45, is pulled forwardly by means of the exposed finger grip 46. A sear 47 is rotatably mounted in the chamber 26A. The sear 47 has spaced shoulders and is under the control of a spring, not shown, urging the sear to turn, as viewed in FIGS. 2 and 3, in a counter-clockwise direction. One sear shoulder is formed to straddle the firing member 37 under the influence of the spring with its rotation limited by engagement of stops 48 with the side walls of the channel 38, the opposite shoulder then in a position to be engaged by the trigger 43.

During extension of the launcher, the plate 34 is moved rearwardly relative to the launcher section 12 and the front sight 32 is erected through the now open port 33 by means of the spring 36. When the launcher is nearly fully extended, the shoulders 40 of the firing member 37 come into engagement with the first named shoulders of the rotary sear 47 which is held against turning by the trigger 43 yieldably backed by the spring 49 so that the firing member 37 is pulled forwardly to tension the firing spring 30. As noted previously, when the launcher is fully extended, the latch 42 is caught in the port 39 and the firing mechanism is cocked.

The front sight 32, see FIGS. 6–10, has a housing, generally indicated at 50, provided with laterally spaced ears 51 which receive the pivot 35 by which it is connected to the housing 26 and which also supports the erecting spring 36. A helical, bimetallic element 52 within the lower part of the housing 50 has one end anchored thereto and its other end connected to the end of the supporting post 53 which is an integral part of and depends from the center of the sighting member 54. The sighting member 54 and post 53 are thin, flat surfaced and slidably guided by the upper part of the housing 50. A satisfactory source of the bimetallic elements is Texas Instruments, Inc. of Attleboro, Mass.

The axial extent of the element 52 increases as its temperature rises above a normal of, say 70° F., and decreases as its temperature falls below that level with consequent raising and lowering of the sighting member 54. In this connection, it will be appreciated that the launcher 10 is not extended to establish its operative state until its use is soon expected and that the element 52 is so well protected by the housing 50 that it responds so slowly to ambient temperatures that it is not then affected thereby. As is apparent from FIG. 4, with the temperature of the element 52 above the normal, the muzzle of the launcher 10 is lowered during sighting to compensate for the increased efficiency of the fuel of the projectile and in the event the temperature of the element is below normal, in sighting, the muzzle becomes raised to compensate for the decreased efficiency of the fuel.

Figure 10:
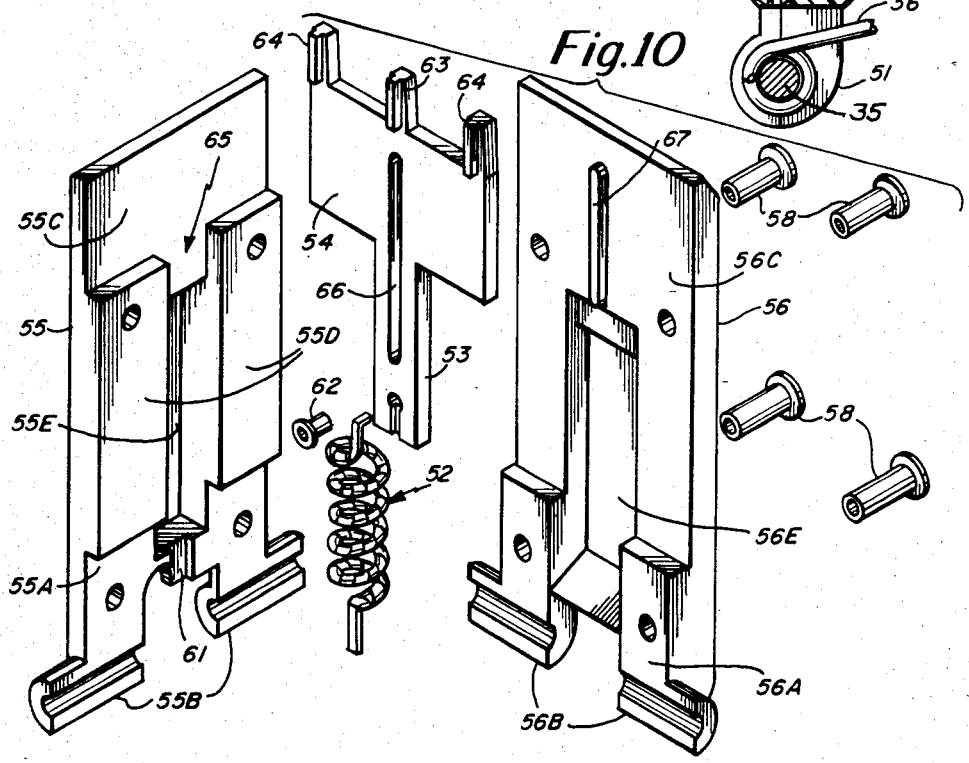
FIG. 10 is an exploded view of its front sight.

In more detail and with particular reference to FIG. 10, the housing 50 consists of sections 55 and 56. The surface of the section 55 which is to fit against the corresponding surface of the section 56 has a lower portion 55A, see FIGS. 7–10, having spaced and laterally extending, arcuate sections 55B each of which forms one-half of the ears 51. Said surface also has an upper portion 55C which and that of the sections 55B are in a plane inclusive of the centers of the ears 51. Between the portions 55A and 55C there are projections 55D, one on each side of a cavity 55E. The projections 55D have transversely aligned upper and lower shoulders and surfaces of the projections are in a plane parallel to the first named plane. The projections 55D extend from a short distance above the lower end of the cavity 55E a short distance above the upper ends thereof.

The corresponding surfaces of the sections 56 include lower portions 56A, one on each side of the cavity 56E, and having spaced, laterally extending, arcuate sections 56B which form the other halves of the ears 51. The surfaces of the portions 56A are in a plane inclusive of the centers of the ears 51 while the remainder of said surface, the portion 56C, is offset by the portions 56A which fit the seat defined by the portions 55A and the lower shoulders of the projections 55D, so as to seat against the portions 55D. When the sections 55 and 56 are assembled, the portion 55C is spaced from the upper end of the portion 56C to establish an open sided seat for the sighting member 54.

Figure 6:
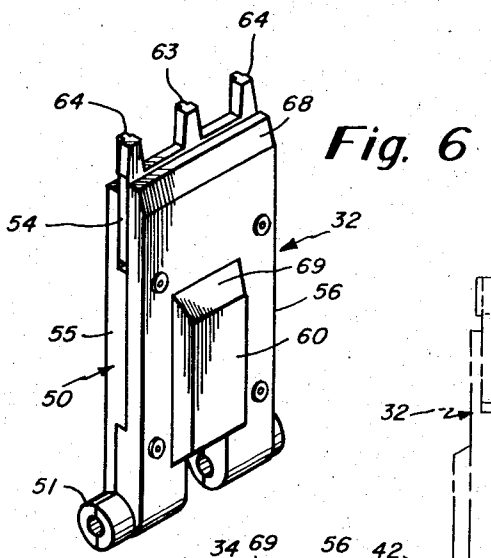
FIG. 6 is a perspective view of the front sight.
Figure 7:
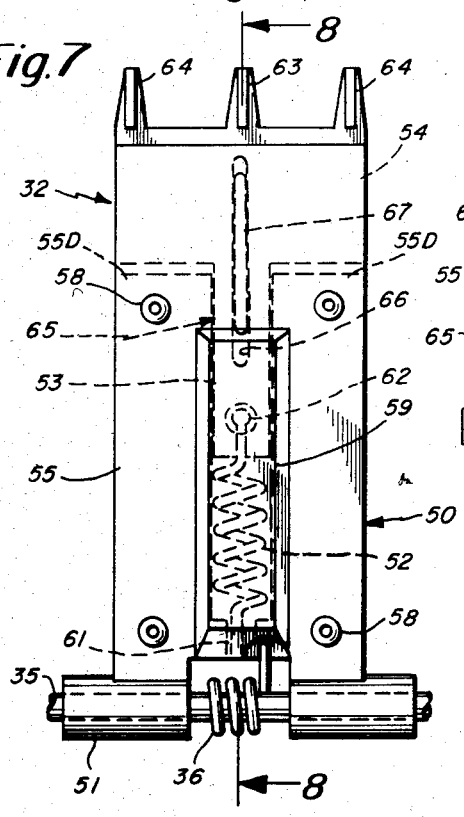
FIG. 7 is a view of the front sight as seen from its back side, i.e., the side facing the rear sight.
Figure 9:
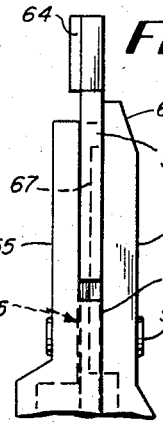
FIG. 9 is a fragmentary side view of the upper end portion of the front sight.
Figure 8:
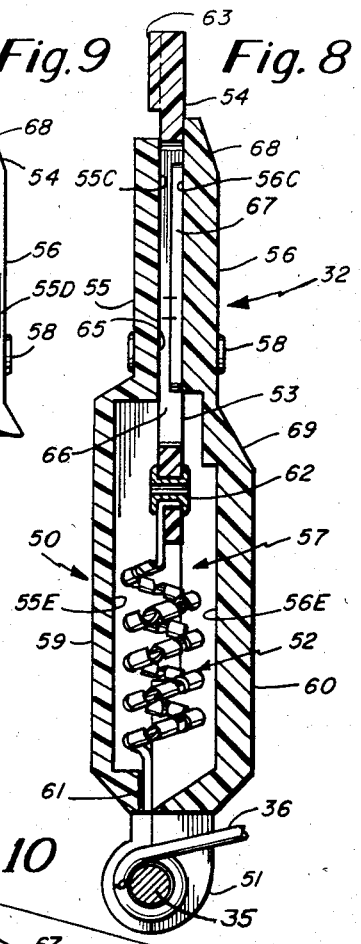
FIG. 8 is a section, on a further increase in scale taken approximately along the indicated line 8—8 of FIG. 7.

In order that the cavities 55E and 56E may be of sufficient depth and length to form, when the sections are united as by rivets 58, a chamber 57, see FIG. 8, which will freely accommodate the element 52, the sections 55 and 56 are formed with external, lengthwise bosses 59 and 60, respectively, see FIGS. 6 and 7. During assembly, the flattened, lower end of the member 52 is adhesively anchored in a groove 61 extending downwardly from the lower end of the cavity 55E and the upper end of the member 52 is secured as by a rivet 62 to the lower end of the post 53 of the sighting member 54. The sections 55 and 56 are united by pairs of rivets 58 above and below the aligned cavities.

The sighting member 54 is of the same width as the sections 55 and 56 and its height is approximately the same as that of the portion 55B. The sighting member 52 has a central sighting post 63 and end posts 64 which are provided to assist in determining leads required for targets moving from right to left or from left to right.

The upper pair of shoulders of the projections 55D, the upper end of the chamber 57 and the portions 55C and 56C establish a short throat, generally indicated at 65 for the post 53 of the sighting member which extends a substantial distance into the chamber 57.

Because of the shortness of the throat 65 and the fact that the sighting member 54 is typically spaced above the upper shoulders of the projections 55D of the open-ended seat, the stability of the sighting post 63 which is essential requires that the post 53 of the sighting member be interconnected by a slidable tongue and groove type of connection. To that end, the supporting post 53 has an accurately dimensioned slot 66 extending substantially the full length thereof which receives an accurately dimensioned tongue or rib 67 on the portion 56C which extends from the upper end thereof. The close tolerances in the dimensions of the rib 67 and the channel 66 together with the length of the rib 67 relative to that of the slot 66 ensures the wanted stability of the sighting post 63 in any position thereof established by the element 52. In practice, the housing and sighting member of the front sight are black and are injection molded utilizing any plastic such as Norel which enables such parts to be produced with suitably close clearances without machining.

Should it be desired to return the launcher 10 to its shortened, inoperative state, it is only necessary to apply digital pressure to the latch 42 through the boot covered port 39 thus to enable the sections 11 and 12 to be telescoped together. It is of course necessary to hold the rear sight 25 in a position for entry into its chamber 27 and to hold the front sight 32 below the port 33 until caught by the leading edge of the plate 34. In order to prevent the sight 32 from stopping the telescoping of the launcher, the upper ends of the section 56 and the boss 60 are chamferred as at 68 and 69, respectively.

I claim:

1. A thermally responsive front sight for a launcher of a projectile the efficiency of the propellant of which varies with the temperature thereof, the launcher of a type thermally insulating the projectile and having a port opening into a thermally insulated housing adjacent the muzzle and provided with a removable closure, said sight including a sighting member having a central sighting post and a central depending supporting post, said sighting member and supporting post integral, and a sight housing including upper and lower portions, said lower portion having means for use in attaching the sight housing to the interior of the launcher housing, said sight housing having a chamber having upper and lower ends, the width of said chamber less than the width of said sighting member and a thermally responsive element in said chamber with an end connected to the sight housing adjacent the lower end of the chamber, said element of a type expanding lengthwise of the chamber as the temperature therein rises and contracting as said temperature falls, and said upper portion of the sight housing having spaced front and back walls providing an upwardly opening seat in which the sighting member is slidable and a throat opening into the upper end of said chamber through which throat the supporting post slidably extends downwardly into the chamber, said supporting post connected within said chamber to the other end of said element, said sighting member and said supporting post and said upper portion including a slidable connection of a tongue and groove type, the working clearances and mating length of which are such as to maintain said sighting post against lateral movement from a predetermined vertical position that would adversely affect sighting accuracy while permitting vertical movements of the sighting member by said element, and the walls of said seat, sight housing and the sighting member dimensioned and disposed to provide surfaces of substantial vertical and lateral extent which are in any vertical position of the sighting member.

2. The front sight of claim 1 in which the tongue and groove connection consists of a rib extending substantially from the upper end of the chamber to the upper end of the housing and a slot extending from close to the lower end of the supporting post close to the upper edge of the sighting member.

3. The front sight of claim 1 in which said throat constitutes a minor part of the surface of the slidable connection.

4. The front sight of claim 3 in which the housing thereof is to be pivotally connected to the interior of the launcher housing forwardly of the opening to swing upwardly and forwardly from within the launcher housing, said housing has two sections each of which has a central, lengthwise cavity, a flat surfaced upper end portion and spaced portions at its lower end shaped and dimensioned to establish one-half of receiving ears for the pivot, one section having a flat surfaced portion inclusive of the spaced portions thereof in the plane of the upper end portion, said sections also having spaced, flat surfaced shouldered projections, the projections of said one section so located relative to those of the other section that the sections may be assembled and united with those of said one section above those of the other section with their respective flat surfaces in engagement with first named flat surfaces and their proximate shoulders abutting, said upper flat surfaced portions then spaced apart to receive the sighting member, said connections and projections establish the chamber with the uppermost shoulders above the upper end thereof and with said ears established.

5. The front sight of claim 4 in which the launcher closure is slidable rearwardly from and forwardly into its post closing position, each section has an external, lengthwise boss into which the cavity thereof extends, the upper end of the section of the sight housing that is uppermost when the sight is within the launcher housing and the upper end of the boss of that section both chamferred thereby to present forwardly sloping surfaces engageable by the closure during the forward movement thereof and cammed thereby out of the path of the closure.

6. A thermally responsive front sight for a launcher of a projectile the efficiency of the propellant of which varies with the temperature thereof, the launcher of a type thermally insulating the projectile and having a port opening into a thermally insulated housing adjacent the muzzle and provided with a removable closure, said sight including a sighting member provided with a central sighting post, said sighting member and post integral, thin and flat surfaced, and a sight housing having a central chamber the width of which is substantially less than the width of the sighting member, said sight housing having a transverse slot in commmunication with said chamber and shaped and dimensioned to receive and slidably confine said sighting member, said sighting member within said slot with a central portion thereof exposed in said chamber and with said sighting post exposed above said sight housing, a thermally responsive element within said chamber with one end anchored in the bottom thereof and the other end thereof attached to said exposed portion of the sighting member, said element of the type expanding lengthwise as the temperature rises and contracting as said temperature falls, and said sighting member and said sight housing including interengaged portions within said housing and within the confines of the sighting member establishing a slidable connection operable to maintain said sighting member against lateral movement while permitting vertical movements of said sighting member by said element.

* * * * *